United States Patent [19]

Bachmann

[11] 4,247,926

[45] Jan. 27, 1981

[54] WATCH MOVEMENT

[75] Inventor: Peter Bachmann, Bettlach, Switzerland

[73] Assignee: Etauches Bettloch, S.A., Bettlach, Switzerland

[21] Appl. No.: 52,461

[22] Filed: Jun. 27, 1979

Related U.S. Application Data

[63] Continuation of Ser. No. 817,717, Jul. 21, 1977, abandoned.

[30] Foreign Application Priority Data

Aug. 9, 1976 [CH] Switzerland ..... 10133/76

[51] Int. Cl.[3] ..... G04B 19/24; G04B 19/06; G04B 37/00

[52] U.S. Cl. ..... 368/28; 368/236; 368/314; 368/316

[58] Field of Search ..... 58/4 R, 5, 52-54, 58/59, 88 R, 104, 127 R, 127 B

[56] References Cited

U.S. PATENT DOCUMENTS

| | | | |
|---|---|---|---|
| 2,473,291 | 6/1949 | Moss | 58/127 R |
| 2,491,453 | 12/1949 | Knobel | 58/52 R |
| 3,025,663 | 3/1962 | Morrison et al. | 58/54 |
| 3,318,086 | 5/1967 | Whitaker | 58/53 |
| 3,996,735 | 12/1976 | Zurcher | 58/50 R |
| 4,023,348 | 5/1977 | Giger et al. | 58/52 R |

FOREIGN PATENT DOCUMENTS

| | | | |
|---|---|---|---|
| 518381 | 4/1954 | Fed. Rep. of Germany | 58/127 R |
| 1111701 | 6/1967 | France | 58/127 R |
| 586923 | 5/1961 | Switzerland | 58/127 R |
| 1258887 | 6/1969 | United Kingdom | 58/127 R |

*Primary Examiner*—Vit W. Miska
*Attorney, Agent, or Firm*—Stevens, Davis, Miller & Mosher

[57] ABSTRACT

A watch movement having a frame comprising a bottom plate with a peripheral rim portion, a dial secured to said rim portion, and a holding plate disposed between the bottom plate and the dial is described, wherein the holding plate is made of a thin sheet of material and includes one or more positioning elements cooperating with the bottom plate and one or more raised support tongues cooperating with the dial.

6 Claims, 2 Drawing Figures

FIG. 1
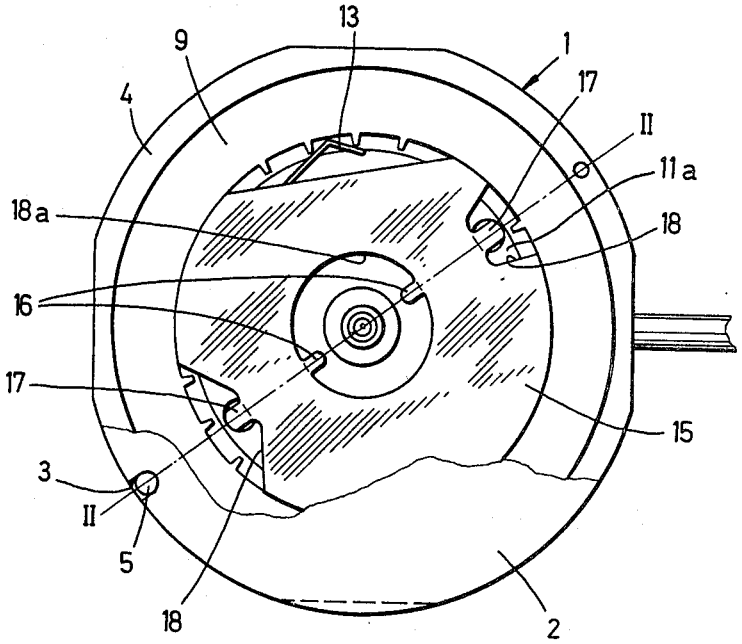
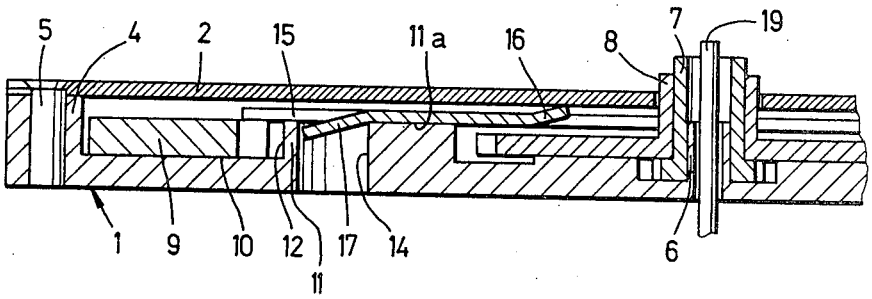
FIG. 2

WATCH MOVEMENT

This is a continuation of application Ser. No. 817,717 filed July 21, 1977, now abandoned.

This invention relates to watch movements of the type having a frame comprising a holding plate disposed between the bottom plate and the dial.

In calendar watch movements, both the elements of the calendar-driving mechanism and the date-ring, as well as the day-disk, if any, are generally known to be held in place by a holding plate forming part of the frame of the movement. Until now, such holding plates have been secured to the bottom plate. With a view to simplifying their manufacture and assembly, various arrangements have already been proposed, particularly a design in which the holding plate is blanked with one or more resilient arms. An example of such an arrangement is that disclosed in Swiss Pat. No. 586,923, for example. Also known are holding plates which serve to hold elements other than those of calendar mechanisms.

In the prior art calendar watch movements, the holding plate is covered by the dial. The latter extends up to the periphery of the bottom plate, to which it is secured by feet or pins. In certain cases, these feet or pins are engaged in holes made in a peripheral rim of the bottom plate surrounding the date-ring. British Pat. No. 1,258,887 teaches an arrangement in which the holding plate and the dial cooperate in the sense that the holding plate has radial arms extending out to the periphery of the bottom plate between the date-ring and the dial so as to support the dial at the location of the fixing pins. The holding plate itself is secured to the bottom plate by screws provided in it central portion. A drawback of this known arrangement, however, is that it requires special manufacturing operations to be performed either on the holding plate or on the date-ring in order to create the space necessary for the movements of the date-ring.

It is an object of this invention to provide a calendar watch movement in which the arrangement of the holding plate is even further simplified in order to reduce both the height of the movement and the operational complications during manufacture.

Still another object of the invention is to provide a watch movement in which the holding plate, instead of being secured to the bottom plate, may itself be held in place by the dial inasmuch as the assembly of the movement ends with the fitting of this display component.

To this end, in the watch movement according to the present invention, the holding plate is made of a thin sheet of material and includes one or more positioning elements cooperating with the bottom plate for determining the position of the holding plate relative to the bottom plate and one or more raised support tongues cooperating with the dial for causing the dial to press the holding plate against the bottom plate.

A preferred embodiment of the invention will now be described in detail with reference to the accompanying drawing, in which:

FIG. 1 is a top plan view of a watch movement according to the invention, and FIG. 2 is a partial section taken on the line II—II of FIG. 1, on a larger scale.

The drawing shows the upper surface of a bottom plate 1 of the movement to be described. A dial 2, made preferably of a plastic material, includes diametrically opposed notches 3 and is secured to a peripheral rim 4 of bottom plate 1 by means of two diametrically opposed conical-headed pins 5. Plate 1 is machined with a central pipe 6 upon which a cannon-pinion 7 rotates. A hour-wheel 8 is fitted on cannon-pinion 7. These two parts are indirectly driven by a minute-wheel (not shown) coupled to a rotary member of the movement. From hour-wheel 8, a driving mechanism (not shown) actuates step by step, at the rate of one step every 24 hours, a date-ring 9 which is accommodated in an annular recess in plate 1. Annular recess 10 is situated just inside rim 4 and is bounded on its inner side by a zone 11, the upper surface 11*a* of which is plane and on a level with the upper face of date-ring 9. The periphery of zone 11 is bounded by the inner side 12 of recess 10 which has the shape of a cylindrical surface extending arcuately over one or more portions of its periphery for guiding date-ring 9. Cylindrical surface 12 is interrupted at the location where date-ring 9 is driven as well as at the location where a jumper-wire 13 cooperates with the inner toothing of date-ring 9. Drilled into supporting surface 11*a* are two diametrically opposed holes 14 having axes parallel to the central axis of the movement. Holes 14 serve the purpose of positioning a holding plate 15 which holds both date-ring 9 and the elements of the calendar mechanism. Holding plate 15 is an extremely thin sheet of steel, produced by blanking, which is for the most part flat but includes two support tongues 16 and two positioning tongues 17.

Tongues 17 extend radially in diametrically opposed directions and are blanked in the bottoms of notches 18 made in the outer edge of holding plate 15. The ends of tongues 17 are arcuately blanked, and they are bent in such a way that the distance between their two end points is equal to the distance between the two generatrices of holes 14 which are the farthest apart. The rounding of the ends of tongues 17 is such that these two ends fit into holes 14 without play at the time of assembly. In an embodiment reduced to practice, the angle of tongues 17 with respect to the plane of holding plate 15 was 40°.

Tongues 16 are blanked radially in diametrically opposed directions at the edge of a circular central aperture 18*a* in holding plate 15. They are bent upward at an angle as may be seen in FIG. 2. When dial 2 is fitted in place, it rests against tongues 16 and thereby presses holding plate 15 against supporting surface 11*a*. The angle at which tongues 16 are bent may be 15°, for example. In the aforementiond reduction to practice, the ends of tongues 16 extended 0.38 mm. above the underside of holding plate 15.

Thus holding plate 15 ensures the axial position of the elements of the calendar mechanism; and although this mechanism is a simple calendar mechanism in the embodiment illustrated in the drawing, the same holding-plate arrangement may also be utilized for ensuring the positioning of a day-date mechanism. Preferably, however, hour-wheel 8 will be held in place axially by a bent annular washer (not shown) disposed within aperture 18*a* and pressing against the underside of dial 2 and upon the upper face of hour-wheel 8 as in a conventional mechanism. However, the inner edge of holding plate 15 might also serve to hold hour-wheel 8 in place.

Although tongues 16 are disposed along the same diameter as tongues 17 and notches 3 for fixing dial 2 in the embodiment illustrated, the relative positions of these various elements might be different. Furthermore, the number of points for securing dial 2, and the number of tongues 16 and 17, might be other than two. It has been found, however, that by rounding the ends of tongues 17 appropriately and selecting appropriate diameters for holes 14, the plane of holding plate 15 can be precisely positioned with two positioning tongues 17 and two corresponding holes 14. The area of supporting surface 11*a* should be large enough, however, to keep holding plate 15 in a completely stable position.

The movement illustrated in the drawing is one in which hour-wheel 9 and cannon-pinion 7 are driven indirectly, including as well a fourth wheel-and-pinion, the arbor 19 of which is disposed within pipe 6; nevertheless, the holding plate described above might equally well be used in movements having a normal gear-train and indicator mechanism. Furthermore, dial 2 might be secured by means of conventional feet or by any other means rather than by pins 5.

What is claimed is:

1. A watch movement having a frame comprising a bottom plate provided with a plane upper face, with one or more holes in said face, with a peripheral rim portion and with an annular recess inwardly of said rim, said movement further comprising a dial secured to said rim portion, a date-ring lodged in said recess and a holding plate located between said dial and said bottom plate for holding said date-ring, said holding plate being made of a thin sheet of material, of generally plane configuration having a peripheral plane portion which extends above said date-ring and including one or more bent portions directed toward the bottom plate, received within said holes of said bottom plate, and forming positioning elements for said holding plate, and one or more raised support tongues cooperating with said dial for causing said dial to press said thin sheet of metal against said plane face.

2. The watch movement of claim 1, wherein said holding plate includes two blanked raised support tongues and a central aperture having an edge, said support tongues projecting from said edge at diametrically opposed locations and being bent at an angle such that respective free ends of said support tongues press against said dial from beneath.

3. The watch movement of claim 1, wherein said holding plate includes two said positioning elements in the form of two blanked and bent positioning tongues, said bottom plate including two holes for respectively receiving said positioning tongues.

4. The watch movement of claim 3, wherein said holding plate includes an outer edge in which said positioning tongues are blanked, said positioning tongues being bent in such a way as to engage within said holes without play.

5. The watch movement of claim 4, wherein said bottom plate further includes a plane surface for supporting said holding plate, said holes being cylindrical and disposed in said plane surface at right angles to the plane of said bottom plate.

6. The watch movement of claim 5, wherein said positioning tongues are bent at an angle and have rounded free ends, the angle of bending and the shape of said free ends being such that said positioning tongues engage within said holes without play when said holding plate rests upon said supporting surface, the distance between said free ends being equal to the distance between the two generatrices of said holes which are the farthest apart.

* * * * *